US009014397B2

(12) United States Patent
Yoneda

(10) Patent No.: US 9,014,397 B2
(45) Date of Patent: Apr. 21, 2015

(54) SIGNAL PROCESSING DEVICE AND SIGNAL PROCESSING METHOD

(75) Inventor: Michiaki Yoneda, Kanagawa (JP)

(73) Assignee: Sony Corporation, Tokyo (JP)

( * ) Notice: Subject to any disclaimer, the term of this patent is extended or adjusted under 35 U.S.C. 154(b) by 412 days.

(21) Appl. No.: 13/369,658

(22) Filed: Feb. 9, 2012

(65) Prior Publication Data

US 2012/0230514 A1 Sep. 13, 2012

(30) Foreign Application Priority Data

Mar. 7, 2011 (JP) ..... 2011-048596

(51) Int. Cl.
*H04R 3/00* (2006.01)
*H04R 29/00* (2006.01)
*H04R 3/04* (2006.01)

(52) U.S. Cl.
CPC *H04R 3/04* (2013.01); *H04R 3/002* (2013.01); *H04R 29/001* (2013.01)

(58) Field of Classification Search
CPC .... H04R 3/0204; H04R 3/002; H04R 25/453; H04R 25/505; H04R 29/001; H04R 5/05; H03G 5/165
USPC ..... 381/59, 93, 96, 98, 103–104, 106–108, 381/312, 318; 700/94; 375/229, 232
See application file for complete search history.

(56) References Cited

U.S. PATENT DOCUMENTS 4,628,530 A * 12/1986 Op De Beek et al. ..... 381/103
2003/0210798 A1* 11/2003 Ohyaba ..... 381/96
2004/0002781 A1* 1/2004 Johnson ..... 700/94
2007/0076906 A1 4/2007 Takagi et al.
2008/0112569 A1 5/2008 Asada
2008/0159568 A1 7/2008 Asada et al.
2009/0190789 A1 7/2009 Liitola et al.
2010/0172516 A1 7/2010 Lastrucci
2010/0246848 A1* 9/2010 Stanley ..... 381/93

(Continued)

FOREIGN PATENT DOCUMENTS

EP 1 923 864 A2 5/2008
EP 1 940 195 A2 7/2008
EP 2 081 403 A1 7/2009

(Continued)

OTHER PUBLICATIONS

U.S. Appl. No. 13/369,493, filed Feb. 9, 2012, Yoneda.

(Continued)

*Primary Examiner* — Xu Mei
(74) *Attorney, Agent, or Firm* — Oblon, McClelland, Maier & Neustadt, L.L.P.

(57) ABSTRACT

A signal processing device includes: a detection unit generating a digital detection signal corresponding to motion of a diaphragm of a speaker to output the digital detection signal; a gain adjustment unit generating a digital feedback signal by multiplying the outputted digital detection signal by again coefficient to output the generated digital feedback signal; a combining unit combining the outputted digital feedback signal with a digital audio signal; a storage unit storing plural gain coefficients; and a control unit performing control so that a given gain coefficient is selected from the plural gain coefficients and that the selected gain coefficient is used for the multiplication.

6 Claims, 9 Drawing Sheets

(56) References Cited

U.S. PATENT DOCUMENTS

| | | | | |
|---|---|---|---|---|
| 2010/0316226 | A1* | 12/2010 | Yoneda et al. | 381/59 |
| 2010/0318205 | A1* | 12/2010 | Ohkuri et al. | 700/94 |

FOREIGN PATENT DOCUMENTS

| | | | | |
|---|---|---|---|---|
| EP | 2 262 279 | A1 | | 12/2010 |
| JP | 2004-200934 | A | | 7/2004 |
| JP | 2005027069 | A | * | 1/2005 |
| JP | 2009-290355 | A | | 12/2009 |
| JP | 2010-288119 | A | | 12/2010 |
| WO | WO 2008/018099 | A1 | | 2/2008 |

OTHER PUBLICATIONS

Extended European Search Report issued Jun. 26, 2012 in Patent Application No. 12154681.6.

Japanese Office Action issued Jan. 6, 2015 in Japanese patent application No. 2011-048596.

* cited by examiner 1
2
3
4
5
LOW-FREQUENCY CORRECTION EQUALIZER
6
7
8
LPF
9
DIGITAL SOURCE
10
ANALOG SOURCE
11
ADC
12
12a
12b
13
DAC
14
15
16
DETECTION/ AMPLIFICATION CIRCUIT
17
ADC
A
B
R1
R2
R3
BRIDGE CIRCUIT
CONTROL UNIT
STORAGE UNIT
MODE SWITCHING

| MODE | CONTENTS | FEEDBACK GAIN K | FEEDBACK GAIN K [dB] | K (16-BIT) |
|---|---|---|---|---|
| A | NEGATIVE FEEDBACK, STRONG | -0.5 | -6 | 0xc000 |
| B | NEGATIVE FEEDBACK, MIDDLE | -0.355 | -9 | 0xd290 |
| C | NEGATIVE FEEDBACK, WEAK | -0.25 | -12 | 0xe000 |
| D | NO FEEDBACK | 0 | MINUS ∞ | 0x0000 |
| E | POSITIVE FEEDBACK, WEAK | 0.125 | 18 | 0x1000 |
| F | POSITIVE FEEDBACK, STRONG | 0.25 | 12 | 0x2000 |

FIG.9

| MODE | CONTENTS | LOW-FREQUENCY CORRECTION EQ GAIN [dB] | a0 | a1 | a2 | b1 | b2 |
|---|---|---|---|---|---|---|---|
| A | NEGATIVE FEEDBACK, STRONG | 21 | 0x4082c4 | 0x801b63 | 0x3f63a4 | 0x7fe49d | 0xc01997 |
| B | NEGATIVE FEEDBACK, MIDDLE | 18 | 0x406992 | 0x802034 | 0x3f7805 | 0x7fdfcc | 0xc01e69 |
| C | NEGATIVE FEEDBACK, WEAK | 15 | 0x405489 | 0x8025ee | 0x3f8855 | 0x7fda12 | 0xc02423 |
| D | NO FEEDBACK | 9 | 0x402e63 | 0x8034d0 | 0x3f9e98 | 0x7fcb30 | 0xc03305 |
| E | POSITIVE FEEDBACK, WEAK | 6 | 0x401e2a | 0x803e69 | 0x3fa537 | 0x7fc197 | 0xc03c9e |
| F | POSITIVE FEEDBACK, STRONG | 3 | 0x400edb | 0x8049d0 | 0x3fa920 | 0x7fe630 | 0xc04805 |

fs=48kHz EQ fo=80Hz,Q=2 COEFFICIENT IS 24-BIT

SIGNAL PROCESSING DEVICE AND SIGNAL PROCESSING METHOD

FIELD

The present disclosure relates to a signal processing device and a signal processing method applicable to, for example, devices reproducing an audio signal.

BACKGROUND

In a field of acoustics, processing of MFB (Motional Feed Back) is known from the past. In the processing of MFB, an electric signal obtained from motion of a speaker diaphragm is detected. The detected electric signal is positively fed back or negatively fed back to an audio signal, thereby controlling the motion of the diaphragm of a speaker unit. The MFB processing of positive feedback enables reproduction of the audio signal with a sense of reverberation. The MFB processing of negative feedback restrains unfavorable sound in low frequencies. Audio systems realizing MFB by analog devices are disclosed in JP-A-10-164685 (Patent Document 1), JP-A-10-070788 (Patent Document 2) and JP-A-2004-200934 (Patent Document 3).

SUMMARY

In the MFB processing of positive feedback, the motion of the speaker diaphragm is increased. When the motion of the diaphragm is increased, reverberation time of the audio signal will be long. On the other hand, in the MFB processing of negative feedback, the motion of the speaker diaphragm in low frequencies is restrained. When the motion of the diaphragm is restrained, reverberation time of the audio signal will be short and unnecessary lower frequency sound is removed. Which MFB processing of positive feedback and negative feedback is performed differs depending on the taste of a listener, listening environment, characteristics of the audio signal and so on. Accordingly, a system in which MFB processing of both positive feedback and negative feedback can be executed and setting in the MFB processing can be changed freely is desirable.

In the analog MFB disclosed in the above Patent Documents 1 to 3, it is difficult to quickly switch between the MGB processing of positive feedback and the MGB processing of negative feedback due to variation in characteristics of circuit devices and so on. It is further difficult to quickly change a gain with respect to a feedback signal in the MFB processing. Moreover, it is difficult to minutely set the gain with respect to the feedback signal. Therefore, there is a problem that it is difficult to perform sound reproduction in accordance with the taste of the listener, listening environment and characteristics of the audio signal.

Accordingly, it is desirable to provide a signal processing device and a signal processing method capable of, for example, quickly performing setting in MFB processing.

An embodiment of the present disclosure is directed to a signal processing device including a detection unit generating a digital detection signal corresponding to motion of a diaphragm of a speaker to output the digital detection signal, a gain adjustment unit generating a digital feedback signal by multiplying the outputted digital detection signal by a gain coefficient to output the generated digital feedback signal, a combining unit combining the outputted digital feedback signal with a digital audio signal, a storage unit storing plural gain coefficients and a control unit performing control so that a given gain coefficient is selected from the plural gain coefficients and that the selected gain coefficient is used for the multiplication.

Another embodiment of the present disclosure is directed to a signal processing method including generating a digital detection signal corresponding to motion of a diaphragm of a speaker to output the digital detection signal, generating a digital feedback signal by multiplying the outputted digital detection signal by a gain coefficient to output the generated digital feedback signal, combining the outputted digital feedback signal with a digital audio signal, storing plural gain coefficients and performing control so that a given gain coefficient is selected from the plural gain coefficients and that the selected gain coefficient is used for the multiplication.

According to at least one embodiment, for example, it is possible to quickly change the setting in MFB processing.

BRIEF DESCRIPTION OF THE DRAWINGS

FIG. 9 is a table showing an example of equalizer coefficients; and

DETAILED DESCRIPTION

Hereinafter, embodiments of the present disclosure will be explained with reference to the drawings. The explanation will be made in the following order.

1. Embodiment
2. Modification Example

An embodiment and a modification example described below are preferred specific examples of the present disclosure and various preferable limitations are added in technical terms, however, the scope of the present disclosure is not limited to the embodiment and the modification example as long as there is no particular description for limiting the present disclosure in the following explanation.

1. Embodiment

Configuration of a Reproducer

Figure 1:
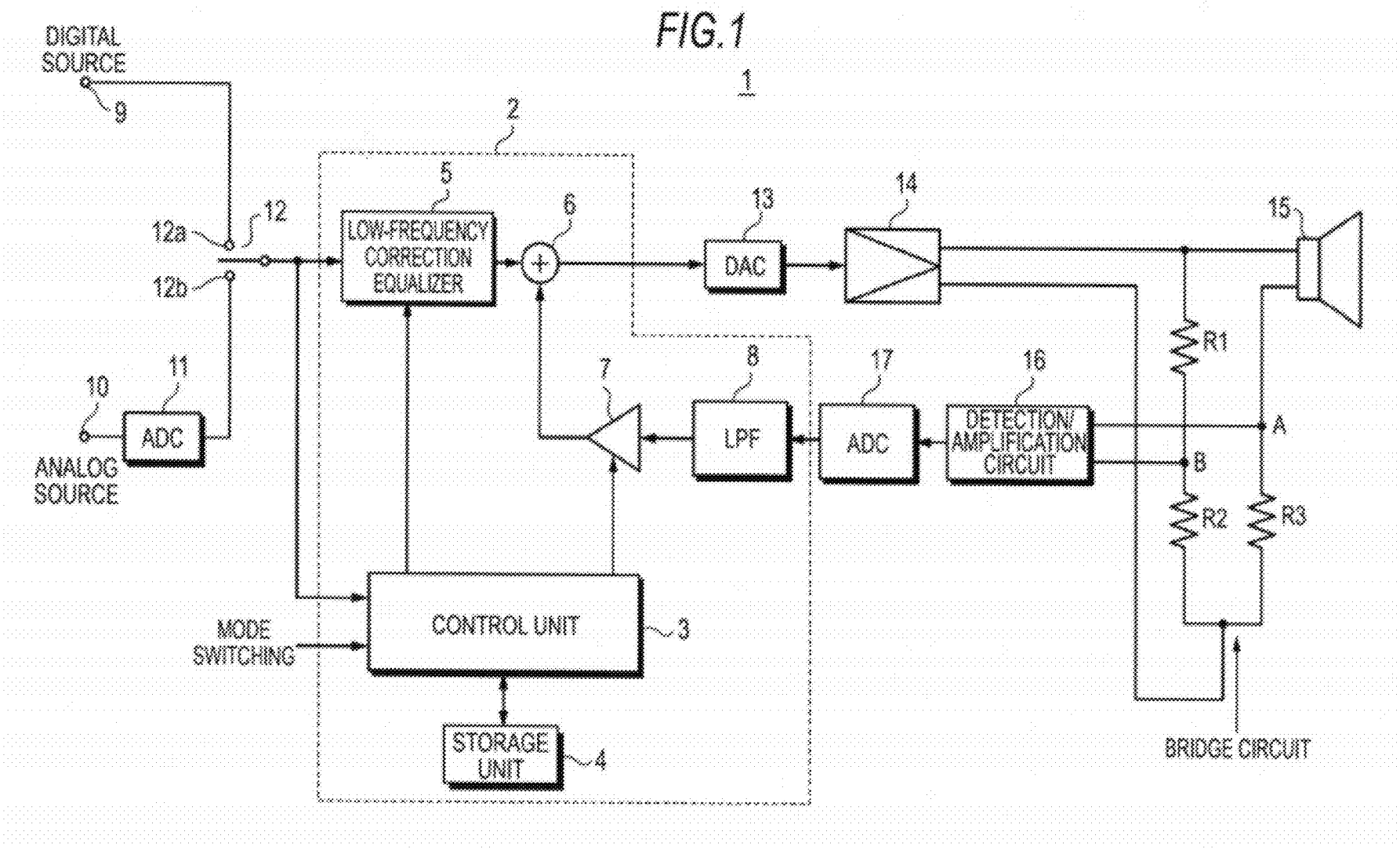
FIG. 1 is a block diagram showing a configuration example of a reproducer.

FIG. 1 is a configuration example of a reproducer 1 according to an embodiment of the present disclosure. The reproducer 1 has a function of reproducing an audio signal to which MFB processing is performed. It goes without saying that an audio signal to which MFB processing is not performed can be reproduced.

The reproducer 1 can be applied to, for example, a television apparatus, a personal computer, a game machine or portable electronic devices. The reproducer 1 includes a digital signal processing unit 2 as an example of a signal processing device. The digital signal processing unit 2 is formed by, for example, a DSP (digital signal processor). The digital signal processing 2 includes, for example, a control unit 3, a storage unit 4, a low-frequency correction equalizer 5, a combining unit 6, a gain adjustment unit 7, an LPF (Low Pass Filter) 8 from a viewpoint of functions. The processing of the digital signal processing unit 2 can be realized by a program.

A digital audio signal and an analog audio signal are supplied to the reproducer 1 as source signals. The digital audio signal is supplied to the reproducer 1 through an input terminal 9. The digital audio signal is, for example, a signal of 48 kHz.

The analog audio signal is supplied to the reproducer 1 through an input terminal 10. The supplied analog audio signal is converted into a digital audio signal by an ADC (Analog to Digital Converter) 11. A sampling frequency "fs" in the ADC 11 is, for example, 48 kHz.

A switch 12 is switched depending on whether the audio signal supplied to the reproducer 1 is the digital audio signal or the analog audio signal. When the digital audio signal is supplied, the switch 12 is connected to a contact 12*a*. When the analog audio signal is supplied, the switch 12 is connected to a contact 12*b*. The switching of the switch 12 is controlled by, for example, the control unit 3, a not-shown CPU (Central Processing Unit) and so on.

When either one of the digital audio signal and the analog audio signal is supplied to the reproducer 1, the switch 12 is not necessary. Moreover, when a sound source can be used for multi-channels and audio signals in respective channels are inputted, configurations corresponding to respective channels can be provided.

The digital audio signal inputted through the input terminal 9 or the digital audio signal supplied from the ADC 11 is selectively outputted from the switch 12. The digital audio signal outputted from the switch 12 is supplied to the low-frequency correction equalizer 5. The low-frequency correction equalizer 5 corrects frequency characteristics of the supplied digital audio signal.

The low-frequency correction equalizer 5 is formed by, for example, a second-order IIR (Infinite Impulse Response) filter. When the low-frequency correction equalizer 5 is formed by the digital filter, characteristics of the low-frequency correction equalizer 5 can be changed easily and rapidly. Moreover, it is not necessary to consider variation in characteristics of devices included in the filter. The characteristics of the low-frequency correction equalizer 5 are prescribed by an equalizer coefficient described later. The equalizer coefficient is selected by, for example, the control unit 3. The selected equalizer coefficient is controlled to be used for correction by the low-frequency correction equalizer 5 by the control unit 3.

In the case where MFB processing is performed without correcting frequency characteristics by the low-frequency correction equalizer 5, power in the vicinity of a low-frequency resonant frequency "f0" in a speaker unit 15 will be reduced in frequency characteristics. The low-frequency correction equalizer 5 previously corrects frequency characteristics of the digital audio signal for preventing the power in the vicinity of the low-frequency resonant frequency "f0" from being reduced. That is, the low-frequency correction equalizer 5 performs correction for previously increasing the power in the vicinity of the low-frequency resonant frequency "f0" which will be attenuated by the MFB processing.

It is possible to reproduce a sound in target frequency characteristics from the speaker unit 15 by previously performing processing by the low-frequency correction equalizer 5. The target frequency characteristics realized by the low-frequency correction equalizer 5 is, for example, flat frequency characteristics. Naturally, characteristics in which low frequency sound is boosted or cut to be a fixed level or arbitrary characteristics can be set. The digital audio signal outputted from the low-frequency correction equalizer 5 can be supplied to the combining unit 6.

The combining unit 6 adds the digital audio signal supplied from the low-frequency correction equalizer 5 to a feedback signal outputted from the gain adjustment unit 7. The digital audio signal outputted from the combining unit 6 is supplied to a DAC (Digital to Analog Converter) 13. The digital audio signal is converted into an analog audio signal by the DAC 13. The analog audio signal outputted from the DAC 13 is supplied to a power amplifier 14.

The power amplifier 14 amplifies the analog audio signal at a given amplification factor. The amplified analog signal is supplied to the speaker unit 15. A voice coil of the speaker unit 15 is vibrated by the analog audio signal to be supplied. The vibration of the voice coil is transmitted to a diaphragm and the diaphragm is vibrated. A sound corresponding to the analog audio signal is reproduced from the speaker unit 15 by the vibration of the diaphragm. The speaker unit 15 is, for example, a speaker unit in which impedance is not changed such as a dynamic speaker.

Some methods of detecting motion of the diaphragm of the speaker unit 15 are known in MFB processing. In the embodiment, a method by using a bridge circuit is used. In the method, the speaker unit 15 is regarded as a resistor and the bridge circuit including the speaker unit 15, a resistor R1, a resistor R2 and a resistor R3 is provided at a signal line between the power amplifier 14 and the speaker unit 15. A resistance value of the speaker unit 15 is, for example, a nominal impedance which is designated by a manufacturer, for example, 4Ω, 8Ω, 16Ω, 32Ω and so on. A contact point between the speaker unit 15 and the resistance R3 is set to, for example, an A point, and a contact point between the resistor R1 and the resistor R2 is set to, for example, a B point.

A detection/amplification circuit 16 detects a potential difference between the A point and the B point. The potential difference between the A point and the B point is generated when an equilibrium condition in the bridge circuit is lost by driving the speaker unit 15. That is, the detection/amplification circuit 16 can detect motion of the diaphragm of the speaker unit 15 by detecting the potential difference between the A point and the B point. A detection signal (potential difference) obtained by the bridge circuit indicates a velocity as the motion of the diaphragm of the speaker unit 15. That is, the MFB method shown in FIG. 1 corresponds to a method called a velocity feedback method.

The detection signal detected by the bridge circuit is supplied to an ADC 17 after being amplified by the detection/amplification circuit 16. The ADC 17 outputs the supplied detection signal after converting the signal into a digital signal. The digital detection signal outputted from the ADC 17 is supplied to the LPF 8 in the digital signal processing unit 2. For example, the bridge circuit, the detection/amplification circuit 16 and the ADC 17 configure a detection unit.

The LPF 8 is, for example, formed by an IIR filter. The LPF 8 transmits only signal components lower than a given frequency band. Frequency components unnecessary for the MFB processing are removed from frequency components of the digital detection signal by the processing of the LPF 8. The digital detection signal transmitted through the LPF 8 is supplied to the gain adjustment unit 7.

The gain adjustment unit 7 multiplies the digital detection signal supplied from the LPF 8 by a given gain coefficient. A feedback signal (digital feedback signal) can be obtained by multiplying the digital detection signal by the given gain coefficient. The gain coefficient may be, for example, a positive gain coefficient or a negative gain coefficient. The gain coefficient may also be "0 (zero)". The gain coefficient is selected by, for example, the control unit 3. The control unit 3 performs control so that the selected gain coefficient is used for multiplication by the gain adjustment unit 7. The feedback signal outputted from the gain adjustment unit 7 is supplied to the combining unit 6. The combining unit 6 combines the digital audio signal with the feedback signal in the digital format.

For example, the digital detection signal is multiplied by a positive gain coefficient in the gain adjustment unit 7 to thereby obtain a feedback signal. The feedback signal is combined with the digital audio signal in the combining unit 6. This case results in a positive feedback operation. For example, the digital detection signal is multiplied by a negative gain coefficient in the gain adjustment unit 7 to thereby obtain a feedback signal. The feedback signal is combined with the digital audio signal in the combining unit 6. This case results in a negative feedback operation. For example, the feedback signal is not generated when the gain coefficient is "0 (zero)". That is, the MFB processing is in an off state. It is also possible to provide a switch between the gain adjustment unit 7 and the combining unit 6. The MFB processing can be turned off when the switch is turned off.

The control unit 3 is connected to the storage unit 4. The storage unit 4 is, for example, a rewritable nonvolatile memory. The storage unit 4 stores plural gain coefficients. The storage unit 4 stores, for example, gain coefficients respectively corresponding to plural modes, which are one or more positive gain coefficients and one or more negative gain coefficients. It is also preferable that the storage unit 4 stores parameters prescribing characteristics of the low-frequency correction equalizer 5. For example, the storage unit 4 may store equalizer coefficients corresponding to plural modes. The details of the gain coefficients and the equalizer coefficients will be described later.

It is also possible to change the gain coefficients stored in the storage unit 4, for example, by user's operation. The gain coefficients can be acquired through a network and can be updated by storing the acquired gain coefficients. The gain coefficients can be fixed.

Plural modes can be set with respect to the reproducer 1. Plural modes are, for example, a mode of executing the MFB processing of positive feedback, a mode of executing the MFB processing of negative feedback and a mode of turning off the MFB processing. It is also preferable to set a mode in which a manner of applying MFB is different in the modes of executing the MFB processing of positive feedback and negative feedback.

The plural modes can be set by, for example, a not-shown user interface. When the mode is designated by the user interface, a mode switching signal is generated. The generated mode switching signal is supplied to the control unit 3. The control unit 3 recognizes the mode designated by the mode switching signal. Then, the control unit 3 selects the gain coefficient corresponding to the recognized mode. The selected gain coefficient is set to the gain adjustment unit 7 under the control by the control unit 3. The control unit 3 can select the equalizer coefficient corresponding to the recognized mode. Then, the selected equalizer coefficient can be set to the low-frequency correction equalizer 5 under the control by the control unit 3.

It is also preferable that the mode is automatically set in accordance with characteristics of the audio signal inputted into the reproducer 1 through the input terminal 9 or the input terminal 10. For example, the digital audio signal outputted from the switch 12 is supplied to the control unit 3. The control unit 3 analyzes, for example, frequency characteristics of the supplied digital audio signal. The control unit 3 recognizes the optimum mode in accordance with the analyzed result and selects the gain coefficient corresponding to the optimum mode. The selected gain coefficient is set to the gain adjustment unit 7 under control by the control unit 3. The control unit 3 may select the optimum equalizer coefficient in accordance with the analyzed frequency characteristics. The selected equalizer coefficient may be set to the low-frequency correction equalizer 5 under control by the control unit 3.

It is also preferable that a category is determined by analysis of the frequency of the digital audio signal by the control unit 3 and that the gain coefficient is selected in accordance with the determined category. It is preferable that sounds in movies and so on have a sense of reverberation to some degree for obtaining strong sounds. On the other hand, it is preferable that audio contents such as classical music are reproduced so as to be faithful to original sounds. Accordingly, for example, when characteristics of the digital audio signal correspond to audio contents such as classical music as a result of analyzing the digital audio signal, the negative gain coefficient is selected by the control unit 3. Moreover, for example, when characteristics of the digital audio signal correspond to movie themes or game music as a result of analyzing the digital audio signal, the positive gain coefficient is selected by the control unit 3.

The method of analyzing characteristics of the digital audio signal is not limited to the method of analyzing frequency characteristics. For example, it is possible that meta information is added to the audio signal inputted to the reproducer 1 and that the category is determined by using the meta information. It is also preferable that the optimum gain coefficient and the equalizer coefficient are included in meta information.

As described above, for example, the user selects one mode from plural modes, thereby selecting reproduction sound having desired characteristics. Moreover, the processing is performed in a digital manner, therefore, the setting with respect to the gain adjustment unit 7 and the like can be quickly performed. For example, it is possible to listen to sound by switching between the audio signal to which MFB of positive feedback is applied and including energetic lower-frequency sound and the audio signal to which MFB of negative feedback is applied and from which unnecessary lower frequency sound is removed. Furthermore, the manner of applying MFB processing can be minutely set.

[Amplitude Characteristics of the Speaker]

Figure 2:
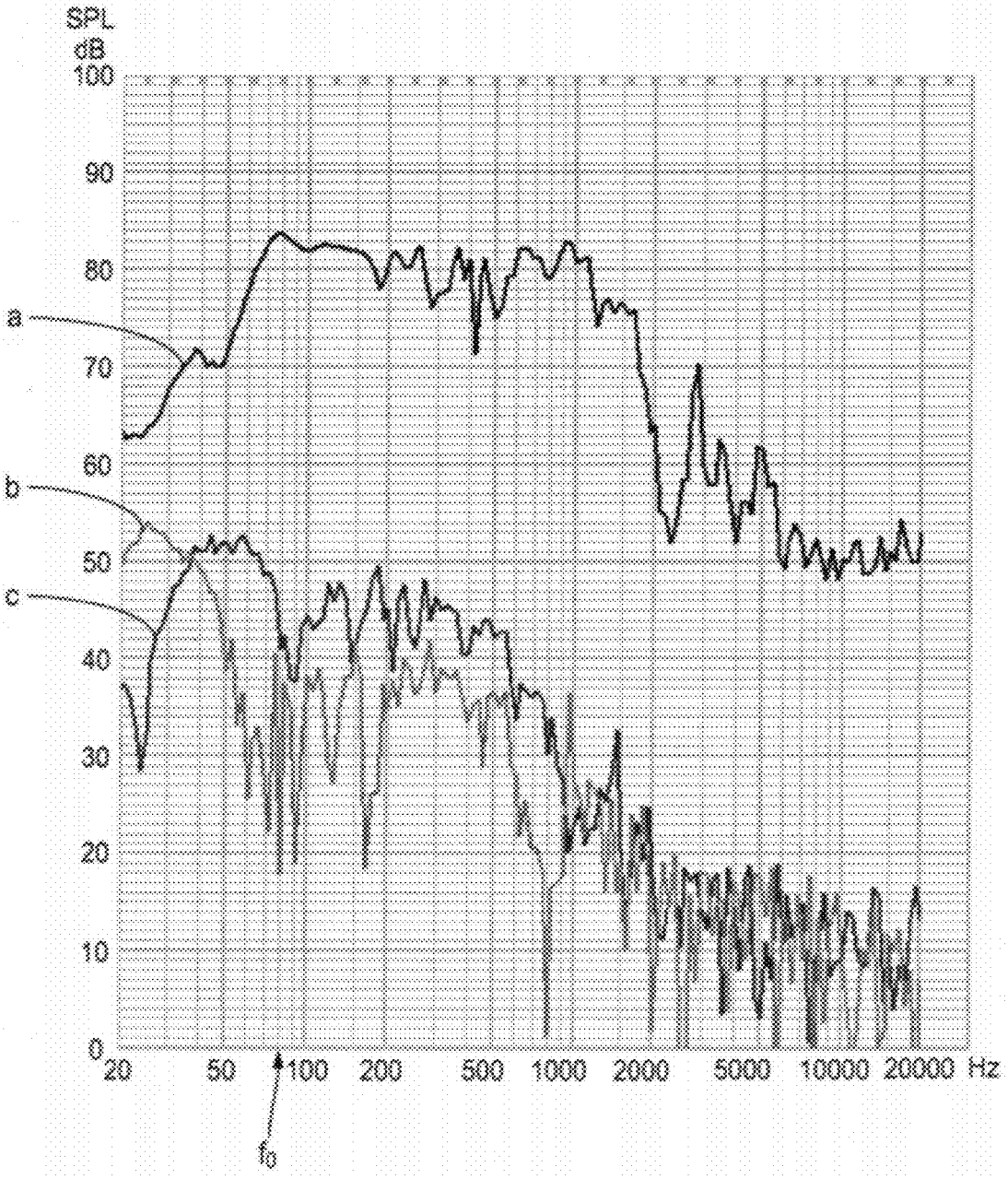
FIG. 2 is a schematic line drawing for explaining output characteristics of a speaker unit obtained when MFB processing is in an off state.

Variation in amplitude characteristics of the speaker unit 15 by the MFB processing will be explained. FIG. 2 shows an example of amplitude characteristics of the speaker unit 15 obtained when the MFB processing is in the off state. In FIG. 2, a waveform "a" represents sound pressure. Waveforms "b" and "c" respectively represent second-order distortion and third-order distortion. The low-frequency resonant frequency "f0" of the speaker unit 15 in the example is, for example, 80 Hz.

Figure 3:
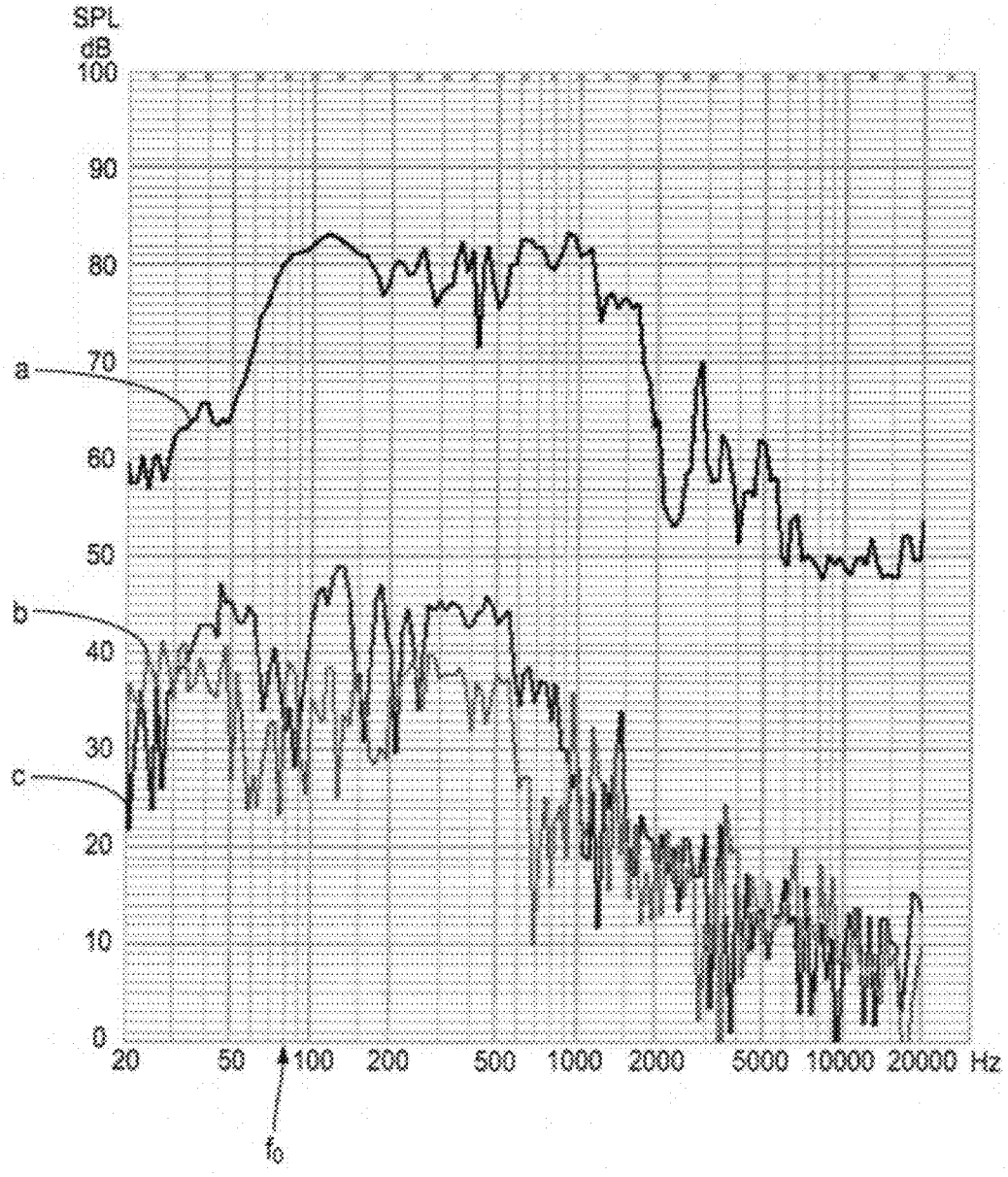
FIG. 3 is a schematic line drawing for explaining output characteristics of the speaker unit obtained when MFB processing of negative feedback is executed.

FIG. 3 shows an example of amplitude characteristics of the speaker unit 15 obtained when the MFB processing of negative feedback is performed. As shown in FIG. 3, a sound pressure level in the vicinity of the low-frequency resonant frequency "f0" is restrained as compared with the case where the MFB processing is in the off state. That is, damping effective for oscillation of the low-frequency resonant frequency "f0" is given by performing the MGB processing of negative feedback is applied.

When flat frequency characteristics are desirable, for example, it is necessary to correct attenuated power in lower frequencies in the frequency characteristics shown in FIG. 3. Accordingly, the attenuated power in lower frequencies is corrected by the MFB processing of negative feedback by the low-frequency correction equalizer 5 as described above.

Figure 4:
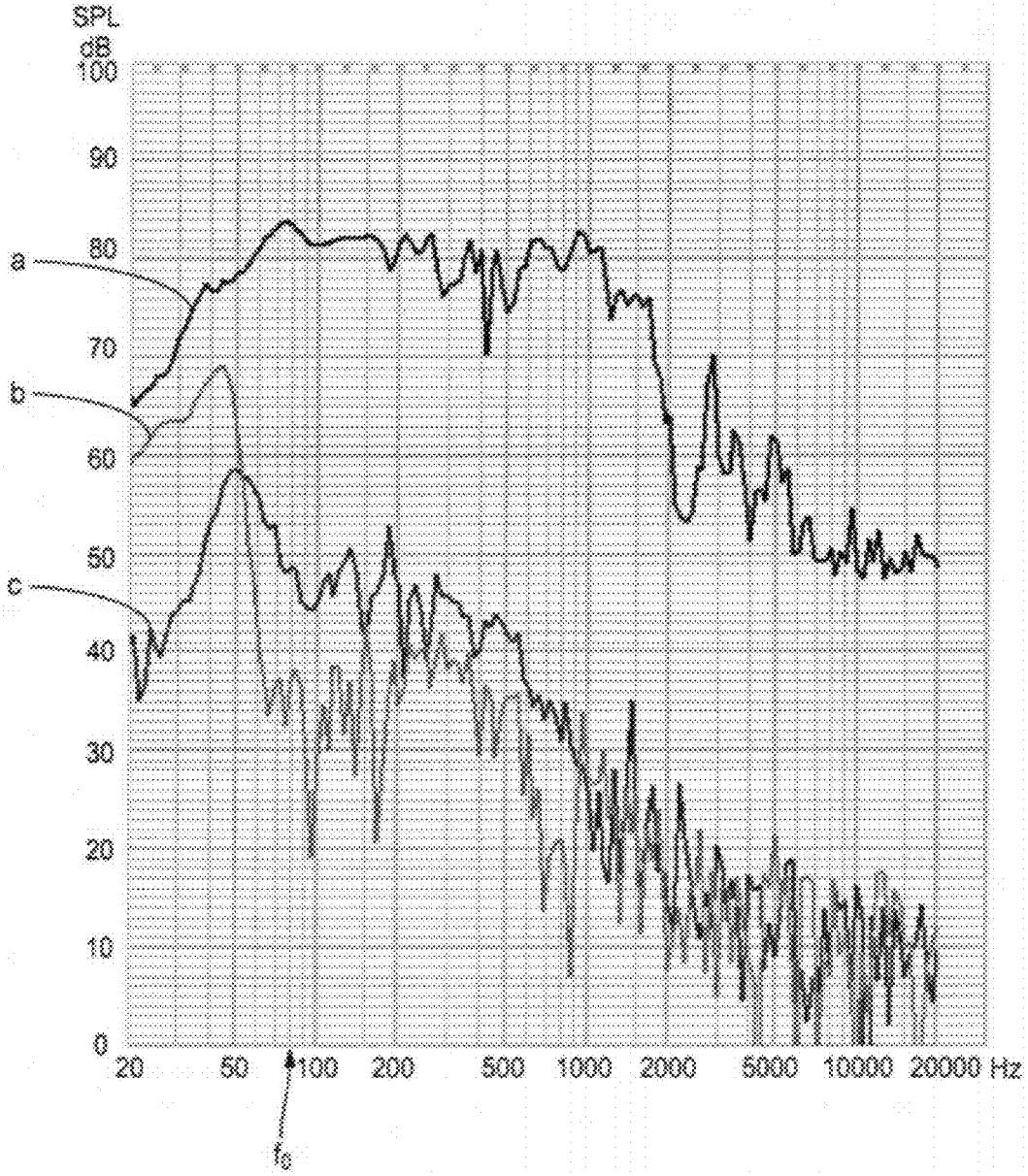
FIG. 4 is a schematic line drawing for explaining output characteristics of the speaker unit obtained when MFB processing of positive feedback is executed.

FIG. 4 shows an example of amplitude characteristics of the speaker unit 15 obtained when the MFB processing of positive feedback is performed. As shown in FIG. 4, the sound pressure level is increased in the vicinity of the low-frequency resonant frequency "f0" as compared with the case where the MFB processing is in the off state. The correction by the low-frequency correction equalizer 5 may be performed when the MFB processing of positive feedback is performed. When the correction by the low-frequency correction equalizer 5 is performed, frequency characteristics of the reproduced audio signal can be desired frequency characteristics.

[Time Responses of the Speaker]

Figure 5A:
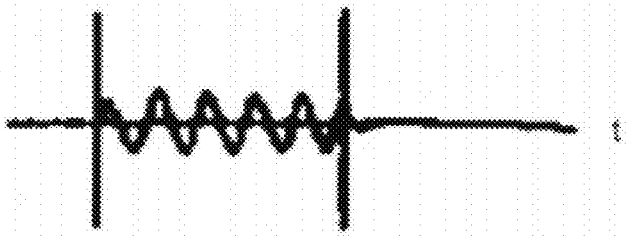
FIGS. 5A to 5D are schematic line drawings for explaining time responses of the speaker unit with respect to a tone burst signal.

Examples of time responses in the speaker unit 15 will be explained with reference to FIG. 5A to FIG. 5D. FIG. 5A shows a waveform of a tone burst signal in which a sine wave is superimposed on a square wave. The tone burst signal has a frequency in the vicinity of the low-frequency resonant frequency "f0" which is, for example, 80 Hz. The tone burst signal shown in FIG. 5A is inputted to the reproducer 1.

Figure 5B:
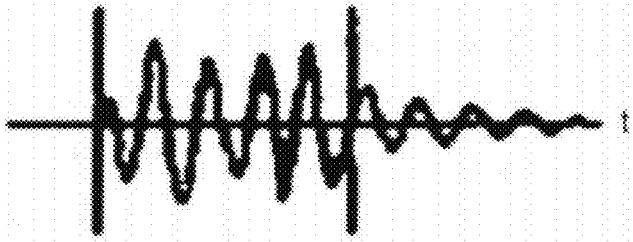
Figure 5C:
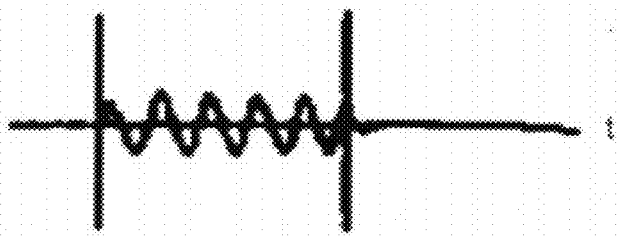
Figure 5D:
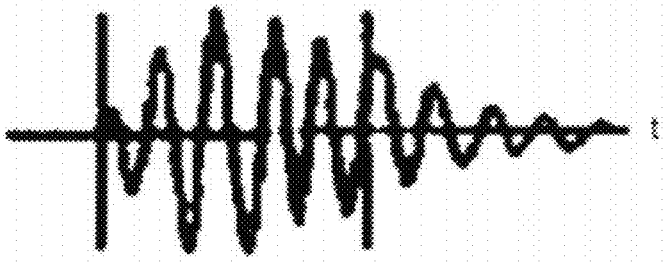

FIG. 5B shows a time response of the speaker obtained when the MFB processing is in the off state. An output waveform obtained when the tone burst signal is inputted represents characteristics in which amplitude is gradually attenuated. FIG. 5C shows a time response of the speaker unit 15 obtained when the MFB processing of negative feedback is performed. An output waveform obtained when the tone burst signal is inputted represents characteristics in which amplitude is attenuated in a short period of time. FIG. 5D shows a time response of the speaker unit 15 obtained when the MFB processing of positive feedback is performed. An output waveform obtained when the tone burst signal is inputted represents characteristics in which amplitude is attenuated over a long period of time.

As shown in FIG. 5C, a sense of reverberation caused by reproduction of the audio signal is removed by performing the MFB processing of negative feedback. It is preferable that the sense of reverberation is reduced in, for example, classical music or jazz music. On the other hand, as shown in FIG. 5D, the sense of reverberation caused by reproduction of the audio signal is increased by performing the MFB processing of positive feedback. It is preferable that the sense of reverberation is emphasized and realistic sensations are realized in, for example, music for movies, games and so on. The reproducer 1 can switch between the MFB processing of positive feedback and negative feedback in accordance with characteristics of the audio signal as described above.

[Gain Coefficient]

Next, the gain coefficient (feedback gain) will be explained. As described above, the gain coefficients are stored in the storage unit 4. For example, gain coefficients respectively corresponding to plural modes are stored in a table, and the table is stored in the storage unit 4. In the storage unit 4, one or more negative gain coefficients and one or more positive gain coefficients are stored. A given gain coefficient in the gain coefficients stored in the storage unit 4 is selected under control by the control unit 3. For example, the gain coefficient corresponding to each mode is selected. The selected gain coefficient is set to the gain adjustment unit 7 under control by the control unit 3.

Figures 6, 7:
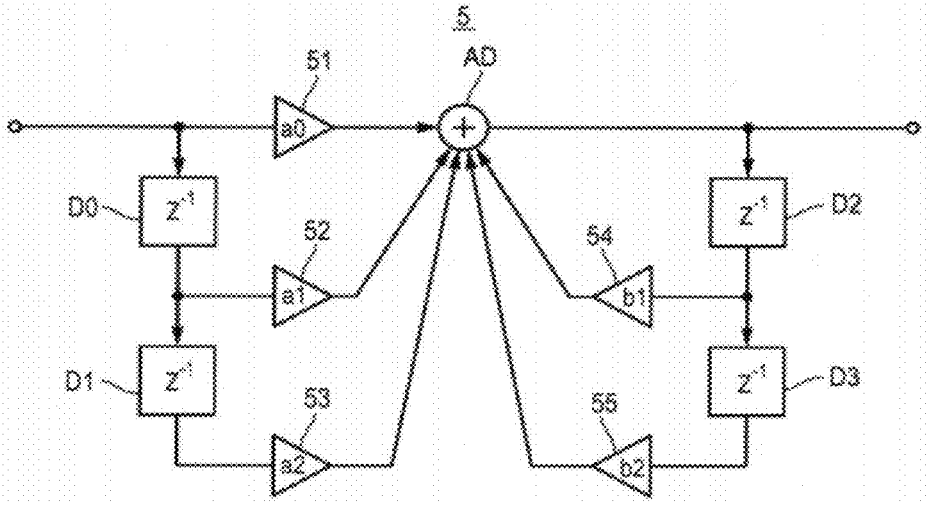
FIG. 6 is a table showing an example of gain coefficients.
FIG. 7 is a block diagram showing a configuration example of a low-frequency correction equalizer.

FIG. 6 shows an example of gain coefficients K (feedback gains K) corresponding to respective modes. In the example shown in FIG. 6, 6-kinds of modes which are a mode A, a mode B, a mode C, a mode D, a mode E and a mode F are prescribed as plural modes. The gain coefficients corresponding to respective modes are set. The gain coefficient is appropriately set in accordance with difference between a peak level (low-frequency resonant frequency "f0") in a system of feedback measured in advance and a target peak level. As higher an absolute value of the gain coefficient is, the larger a feedback amount to the digital audio signal becomes.

The mode A is a mode in which the MFB of negative feedback is strongly applied. In the mode A, the gain coefficient K is, for example, −0.5. A value obtained by converting the gain coefficient K into a decibel (dB) (feedback gain |K|) is −6 dB. The gain coefficient K is presented as "0xc000" in 16-bit. Note that "0x" indicates notation in hexadecimal.

The mode A is a mode in which the absolute value of the gain coefficient K is higher than other modes. That is, the level of the feedback signal is increased. As the gain coefficient K is negative, feedback will be negative. That is, the mode A will be a mode in which the MFB of negative feedback is strongly applied.

The mode B is a mode in which the MFB of negative feedback which is weaker than the mode A is applied. In the mode B, the gain coefficient K is, for example, −0.355. A value obtained by converting the gain coefficient K into the decibel (dB) (feedback gain |K|) is −9 dB. The gain coefficient K is presented as "0xd290" in 16-bit.

The mode C is a mode in which the MFB of negative feedback which is weaker than the mode B is applied. In the mode C, the gain coefficient K is, for example, −0.25. A value obtained by converting the gain coefficient K into the decibel (dB) (feedback gain |K|) is −12 dB. The gain coefficient K is presented as "0xe000" in 16-bit.

The mode D is a mode in which the feedback signal will be "0 (zero)". That is, the mode D is a mode in which the MFB is turned off. In the mode D, the gain coefficient K is "0 (zero)". A value obtained by converting the gain coefficient K into the decibel (dB) (feedback gain |K|) is −∞. The gain coefficient K is presented as "0x0000" in 16-bit.

The mode E is a mode in which the MFB of positive feedback is weakly applied. In the mode E, the gain coefficient K is, for example, 0.125. A value obtained by converting the gain coefficient K into the decibel (dB) (feedback gain |K|) is 18 dB. The gain coefficient K is presented as "0x1000" in 16-bit. In the mode E, the gain coefficient K is lower than other modes, therefore, the feedback amount is reduced. As the gain coefficient K is positive, feedback will be positive. That is, the mode E is a mode in which the MFB of positive feedback is weakly applied.

The mode F is a mode in which the MFB of positive feedback which is stronger than the mode E is applied. In the mode F, the gain coefficient K is, for example, 0.25. A value obtained by converting the gain coefficient K into the decibel (dB) (feedback gain |K|) is 12 dB. The gain coefficient K is presented as "0x2000" in 16-bit.

In the storage unit 4, for example, one or more positive gain coefficients and one or more negative gain coefficients are stored. The gain coefficients are switched between positive and negative values, as a result, the MFB including the positive feedback and the negative feedback can be switched. Moreover, plural values of gain coefficients are set, thereby realizing the MFB processing having different application manners. Therefore, the MFB processing appropriate to the taste of a listener, listening environment, and characteristics of the audio signal can be executed.

[Low-Frequency Correction Equalizer]

FIG. 7 shows a configuration example of the low-frequency correction equalizer 5. The low-frequency correction equalizer 5 is formed by, for example, a second-order IIR filter. The low-frequency correction equalizer 5 can be formed by a FIR filter. It is possible to change characteristics of the low-frequency correction equalizer 5 easily and quickly by forming the low-frequency correction equalizer 5 by digital circuits.

As shown in FIG. 7, the low-frequency correction equalizer 5 includes a delay device D0 and a delay device D1 in a previous stage of an adder AD. The low-frequency correction equalizer 5 further includes a multiplier 51, a multiplier 52 and a multiplier 53 for multiplying respective equalizer coefficients "a0", "a1" and "a2" in a previous stage of the adder AD. In the example, the equalizer coefficients represent filter coefficients.

The low-frequency correction equalizer 5 includes a delay device D2 and a delay device D3 in a subsequent stage of the adder AD. The low-frequency correction equalizer 5 further includes a multiplier 54 and a multiplier 55 for multiplying respective equalizer coefficients "b1" and "b2" in a subsequent stage of the adder AD. Respective outputs of the multipliers 51, 52, 53, 54 and 55 are added by the adder AD.

Figure 8:
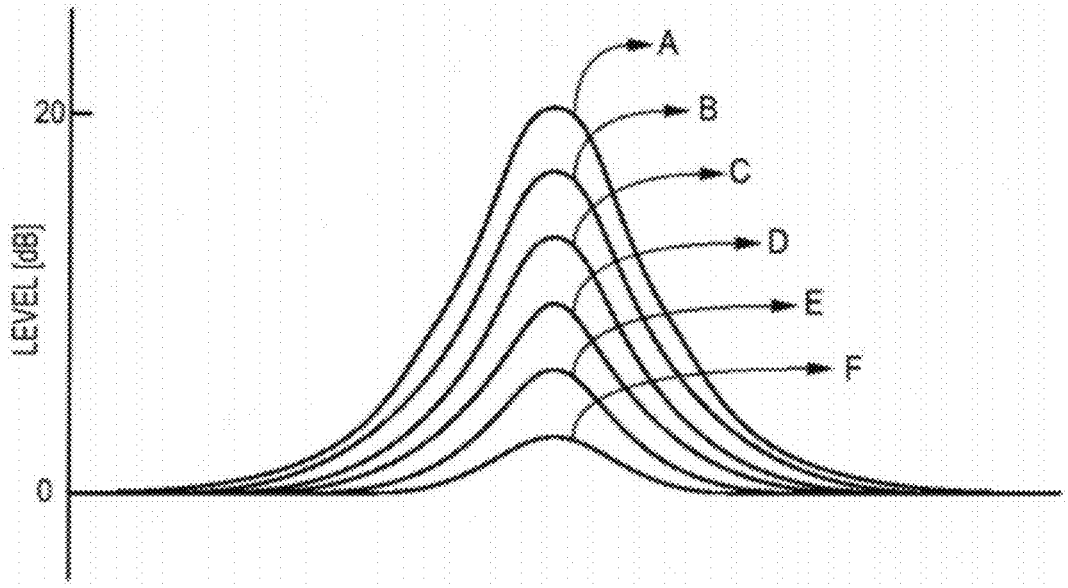
FIG. 8 is a schematic line drawing showing an example of characteristics of the low-frequency correction equalizer in respective modes.

It is possible to set characteristics corresponding to, for example, the above six modes A to F with respect to the low-frequency correction equalizer 5. FIG. 8 schematically shows an example of characteristics of the low-frequency correction equalizer 5 obtained when respective modes are set. The example of characteristics of the low-frequency correction equalizer 5 shown in FIG. 8 is merely an example, and characteristics are not limited to the example.

For example, in the audio signal to which the MFB processing in the mode A is performed, a level in the vicinity of the low-frequency resonant frequency "f0" is attenuated. In the mode A, the absolute value of the gain coefficient is high and the MFB of negative feedback is strongly applied, therefore, attenuation of the level in the vicinity of the low-frequency resonant frequency "f0" will be high. Accordingly, characteristics of the low-frequency correction equalizer 5 are set so as to increase a correction level.

The correction level is reduced in the order of the mode A, the mode B, the mode C, the mode D, the mode E and the mode F. That is, characteristics of the low-frequency correction equalizer 5 are set so that, for example, the correction level is increased when the negative feedback amount to the digital audio signal is large, and the correction level is reduced when the positive feedback amount to the digital audio signal is large.

FIG. 9 shows an example of equalizer coefficients in respective modes. In this case, a frequency fs of the digital audio signal inputted to the low-frequency correction equalizer 5 is 48 kHz. Compensation by the low-frequency correction equalizer 5 is made, for example, in a band in the vicinity of the low-frequency resonant frequency "f0". The low-frequency resonant frequency "f0" is, for example, 80 Hz. Q-value is, for example, 2. Respective equalizer coefficients are set to corresponding multipliers so as to correspond to respective modes. The equalizer coefficients are, for example, 24-bit.

The mode A is a mode in which the MFB of negative feedback is strongly applied. The power in the vicinity of the low-frequency resonant frequency "f0" is largely reduced. Therefore, when the MFB processing by the mode A is executed, the compensation level by the low-frequency correction equalizer 5 is increased. When the MFB processing by the mode A is executed, for example, a gain compensation of 21 dB is made by the low-frequency correction equalizer 5.

In the mode A, "0x4082c4" is set as an equalizer coefficient "a0" of the multiplier 51, "0x801b63" is set as an equalizer coefficient "a1" of the multiplier 52, "0x3f63a4" is set as an equalizer coefficient "a2" of the multiplier 53, "0x7fe49d" is set as an equalizer coefficient "b1" of the multiplier 54, "0xc01997" is set as an equalizer coefficient "b2" of the multiplier 55, respectively.

When the MFB by the mode B is executed, for example, a gain compensation of 18 dB is made by the low-frequency correction equalizer 5. In the mode B, for example, "0x406992" is set as the equalizer coefficient "a0" of the multiplier 51, "0x802034" is set as the equalizer coefficient "a1" of the multiplier 52, "0x3f7805" is set as the equalizer coefficient "a2" of the multiplier 53, "0x7fdfcc" is set as the equalizer coefficient "b1" of the multiplier 54, "0xc01e69" is set as the equalizer coefficient "b2" of the multiplier 55, respectively.

When the MFB by the mode C is executed, for example, a gain compensation of 15 dB is made by the low-frequency correction equalizer 5. In the mode C, for example, "0x405489" is set as the equalizer coefficient "a0" of the multiplier 51, "0x8025ee" is set as the equalizer coefficient "a1" of the multiplier 52, "0x3f8855" is set as the equalizer coefficient "a2" of the multiplier 53, "0x7fda12" is set as the equalizer coefficient "b1" of the multiplier 54, "0xc02423" is set as the equalizer coefficient "b2" of the multiplier 55, respectively.

The gain compensation by the low-frequency correction equalizer 5 can be made in the mode D in which the MFB is in the off state. When the MFB by the mode D is executed, for example, a gain compensation of 9 dB is made by the low-frequency correction equalizer 5. In the mode D, for example, "0x402e63" is set as the equalizer coefficient "a0" of the multiplier 51, "0x8034d0" is set as the equalizer coefficient "a1" of the multiplier 52, "0x3f9e98" is set as the equalizer coefficient "a2" of the multiplier 53, "0x7fcd30" is set as the equalizer coefficient "b1" of the multiplier 54, "0xc03305" is set as the equalizer coefficient "b2" of the multiplier 55, respectively.

The gain compensation by the low-frequency correction equalizer 5 can be made in the mode E and the mode F in which the MFB of positive feedback is performed. When the MFB by the mode E is executed, for example, a gain compensation of 6 dB is made by the low-frequency correction equalizer 5. In the mode E, for example, "0x401e2a" is set as the equalizer coefficient "a0" of the multiplier 51, "0x803e69" is set as the equalizer coefficient "a1" of the multiplier 52, "0x3fa537" is set as the equalizer coefficient "a2" of the multiplier 53, "0x7fc197" is set as the equalizer coefficient "b1" of the multiplier 54, "0xc03c9e" is set as the equalizer coefficient "b2" of the multiplier 55, respectively.

When the MFB processing by the mode F is executed, for example, a gain compensation of 3 dB is made by the low-frequency correction equalizer 5. In the mode E, for example, "0x400edb" is set as the equalizer coefficient "a0" of the multiplier 51, "0x8049d0" is set as the equalizer coefficient "a1" of the multiplier 52, "0x3fa920" is set as the equalizer coefficient "a2" of the multiplier 53, "0x7fe630" is set as the equalizer coefficient "b1" of the multiplier 54, "0xc04805" is set as the equalizer coefficient "b2" of the multiplier 55, respectively.

As described above, in the storage unit 4, plural equalizer coefficients are stored so as to correspond to plural modes. In the case where the low-frequency correction equalizer 5 is formed by, for example, a second-order IIR filter, six equalizer coefficients are stored in each mode. The equalizer coefficients are selected by the control unit 3 in accordance with each mode. The selected equalizer coefficients are controlled to be used for correction by the low-frequency correction equalizer 5 by the control unit 3. As the processing by the control unit 3 is performed in digital processing, the setting of equalizer coefficients can be quickly performed. Moreover, the change of equalizer coefficients in accordance with the mode change can be quickly performed. The gain coefficients and the equalizer coefficients are set in a range in which a gain margin or a phase margin is satisfied. It is also preferable that a positive gain coefficient is set and the MFB of positive feedback is performed when the gain margin is sufficient.

2. Modification Example

The embodiment has been specifically explained as the above, and it goes without saying that the embodiment can be variously modified. Hereinafter, a modification example will be explained.

Figure 10:
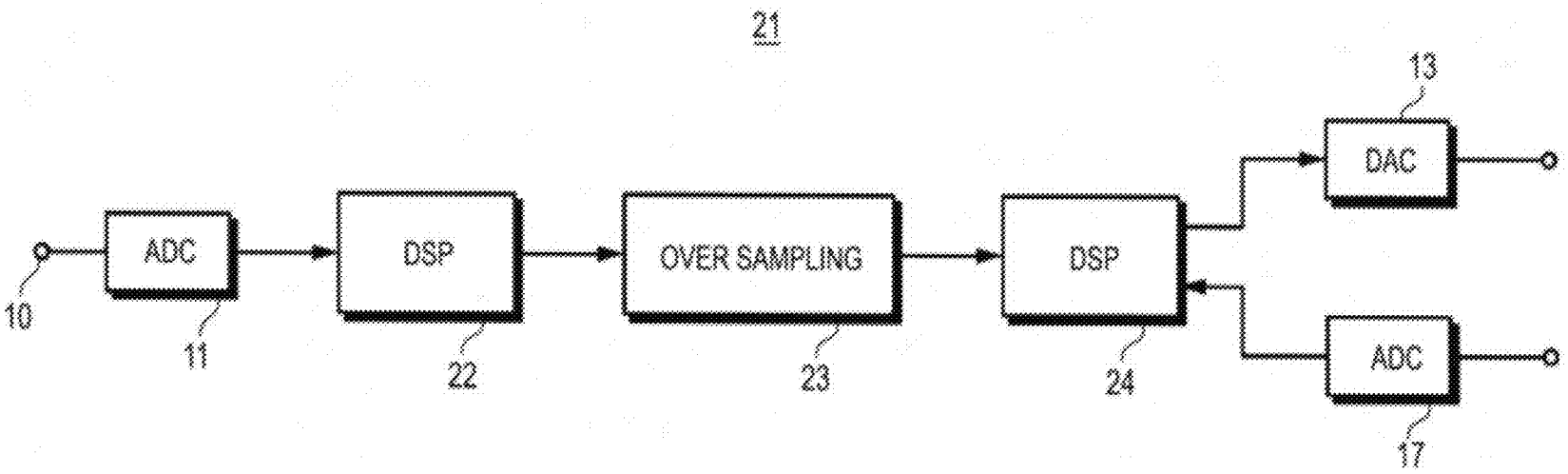
FIG. 10 is a block diagram showing a configuration example of a reproducer in a modification example.

FIG. 10 shows a configuration example of a reproducer 21 according to a modification example. In FIG. 10, the same numerals are given to the same components as the above reproducer 1, and part of components is omitted.

An analog audio signal is inputted from the input terminal 10 of the reproducer 21. The analog audio signal is converted into a digital audio signal by the ADC 11. The sampling frequency "fs" is, for example, 48 kHz. The sampling frequency "fs" in the processing of the ADC 11 is appropriately referred to as "1fs" as a reference frequency. The converted digital audio signal is supplied to a DSP 22.

The DSP 22 executes functions of the above low-frequency correction equalizer 5 to the supplied digital audio signal. That is, the processing of compensating the gain in the vicinity of the low-frequency resonant frequency "f0" which is reduced by the MFB is executed. The equalizer coefficients in the DSP 22 are suitably set, for example, in accordance of plural modes. The digital audio signal outputted from the DSP 22 is supplied to an over sampling unit 23 which is an example of a frequency converter.

The over-sampling unit 23 executes over-sampling processing to the supplied digital audio signal. The over-sampling unit 23 executes over-sampling processing of converting the frequency of the digital audio signal to be N-times higher than "1fs". "N" is, for example, the power of 2, which is 8 (8fs) as an example. The digital audio signal to which the over-sampling processing is performed is supplied to a DSP 24.

The DSP 24 has functions of the combining unit 6, the gain adjustment unit 7 and the LPF 8 in the above reproducer 1. The gain coefficients in the DSP 24 are suitably set, for example, in accordance with plural modes. The digital audio signal outputted from the DSP 24 is converted into an analog audio signal by the DAC 13. Then, the analog audio signal outputted from the DAC 13 is supplied to the speaker unit 15 (not shown).

A detection signal outputted from the detection/amplification circuit 16 (not shown) is supplied to the ADC 17. In the ADC 17, the detection signal is converted into a digital detection signal. The converted digital detection signal is supplied to the DSP 24. In the DSP 24, the processing of the combining unit 6, the gain adjustment unit 7 and the LPF 8 is executed.

It is possible to improve sound quality of the audio signal to be reproduced by performing the over-sampling processing. The frequency used after the over-sampling processing is set to 8fs, thereby improving sound quality as well as suppressing delay time caused by the over-sampling processing to the minimum. The frequency used after the over-sampling processing is not limited to 8fs. However, the frequency is preferably 4fs to 8fs in consideration of delay time caused by the processing.

According to the embodiment, the MFB processing of positive feedback and negative feedback is executed, for example, by multiplying a positive gain coefficient or a negative gain coefficient. For example, it is also preferable to execute the MFB processing of positive feedback and negative feedback by setting all gain coefficients to be positive values and by switching the combining unit 6 between addition/subtraction. It is further preferable to provide a limiter circuit and so on for limiting the level of the audio signal in the reproducer 1 for preventing oscillation due to the execution of the MFB processing of positive feedback.

In the above producer 1, motion of the diaphragm of the speaker unit 15 is detected by the bridge circuit. It is also preferable to detect displacement of the diaphragm by capacitance or a laser displacement gauge instead of the bridge circuit. It is further preferable to provide a coil different from the voice coil of the speaker unit 15 as a sensor for detecting the velocity to detect electric current by the coil. It is further preferable to detect motion of the diaphragm by using an acceleration sensor or a microphone. It is further preferable to detect motion of the diaphragm of the speaker unit 15 by a digital sensor. In this case, output of the digital sensor is directly supplied to the digital signal processing unit 2.

The so-called velocity feedback MFB has been described above, however, the MFB is not limited to the embodiment. For example, an acceleration feedback MFB can be used. In the acceleration feedback MFB, for example, a differential processing unit is provided between the ADC 17 and the LPF 8. Differential processing is performed to the detection signal by the differential processing unit. To perform differential processing corresponds to calculation of acceleration as the motion of the diaphragm. It is also preferable that the signal to which differential processing is performed is supplied to the LPF 8.

The reproducer 1 may have a configuration responding to the velocity feedback type and the acceleration feedback type. It is possible to allow both of the velocity feedback type and the acceleration feedback type to be available. For example, it is possible that a feedback signal in the velocity feedback type, a feedback signal in the acceleration feedback type and the digital audio signal are combined.

The reproducer 1 can be applied to, for example, headphones. In the case of being applied to the headphones, the reproducer 1 can be configured by including headphones and an audio player separately. For example, it is preferable that the bridge circuit is provided on the headphones' side and other components which are the digital signal processing unit 2, the DAC 13, the detection/amplification circuit 16, the ADC 17 and so on are provided on the audio player's side. Signal transmission and reception are performed by wireless or wired manner between the headphones and the audio player.

The series of processing according to the embodiment can be configured as a method, a program and a storage medium in which the program is recorded. Furthermore, processing in the embodiment and the modification example can be suitably combined within a scope in which technical contradiction does not occur.

The present disclosure contains subject matter related to that disclosed in Japanese Priority Patent Application JP 2011-048596 filed in the Japan Patent Office on Mar. 7, 2011, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A signal processing device comprising:

circuitry configured to:

generate a digital detection signal corresponding to motion of a diaphragm of a speaker to output the digital detection signal;

generate a digital feedback signal by multiplying the outputted digital detection signal by a gain coefficient to output the generated digital feedback signal;

correct frequency characteristics of a digital audio signal;

combine the outputted digital feedback signal with the digital audio signal in which the frequency characteristics are corrected;

store plural gain coefficients and plural equalizer coefficients;

perform control so that a given gain coefficient is selected from the plural gain coefficients and that the selected gain coefficient is used for the multiplication; and perform control so that given equalizer coefficients are selected from the plural equalizer coefficients and that the selected equalizer coefficients are used for the correction of the frequency characteristics by the circuitry, wherein one or more positive gain coefficients and one or more negative gain coefficients are stored in the circuitry, the circuitry executes processing of positive feedback when the one positive gain coefficient is selected, and processing of negative feedback when the one negative gain coefficient is selected, and the circuitry selects the equalizer coefficients so that a correction level of the frequency characteristics used when the processing of positive feedback using the positive gain coefficient multiplied to the outputted digital detection signal is executed is lower than a correction level of the frequency characteristics used when the processing of negative feedback using the negative gain coefficient multiplied to the outputted digital detection signal is executed.

2. The signal processing device according to claim 1, wherein the circuitry converts a frequency of the combined digital audio signal to be N-times.

3. The signal processing device according to claim 1, wherein the circuitry analyzes characteristics of the digital audio signal and selects the gain coefficient in accordance with the analysis result.

4. The signal processing device according to claim 1, wherein the circuitry analyzes characteristics of the digital audio signal and selects the equalizer coefficients in accordance with the analysis result.

5. The signal processing device according to claim 1, wherein the circuitry selects the equalizer coefficients so that correction levels of the frequency characteristics are reduced as the gain coefficients selected by the circuitry increase.

6. A signal processing method comprising:

generating a digital detection signal corresponding to motion of a diaphragm of a speaker to output the digital detection signal;

generating a digital feedback signal by multiplying the outputted digital detection signal by a gain coefficient to output the generated digital feedback signal;

correcting frequency characteristics of a digital audio signal;

combining the outputted digital feedback signal with the digital audio signal in which the frequency characteristics are corrected;

storing plural gain coefficients and plural equalizer coefficients;

performing, by circuitry, control so that a given gain coefficient is selected from the plural gain coefficients and that the selected gain coefficient is used for the multiplication; and performing, by the circuitry, control so that given equalizer coefficients are selected from the plural equalizer coefficients and that the selected equalizer coefficients are used for the correction of the frequency characteristics, wherein one or more positive gain coefficients and one or more negative gain coefficients are stored in the circuitry, and the method further comprising:

executing, by the circuitry, processing of positive feedback when the one positive gain coefficient is selected, and processing of negative feedback when the one negative gain coefficient is selected, and selecting, by the circuitry, the equalizer coefficients so that a correction level of the frequency characteristics used when the processing of positive feedback using the positive gain coefficient multiplied to the outputted digital detection signal is executed is lower than a correction level of the frequency characteristics used when the processing of negative feedback using the negative gain coefficient multiplied to the outputted digital detection signal is executed.

* * * * *